US010358939B2

(12) United States Patent
Walston et al.

(10) Patent No.: US 10,358,939 B2
(45) Date of Patent: Jul. 23, 2019

(54) TURBINE VANE WITH HEAT SHIELD

(71) Applicant: Rolls-Royce Corporation, Indianapolis, IN (US)

(72) Inventors: Jeffrey A. Walston, Indianapolis, IN (US); Aaron D. Sippel, Zionsville, IN (US); Tara G. Schetzel, Indianapolis, IN (US); David J. Thomas, Brownsburg, IN (US); Jun Shi, Carmel, IN (US); Brad D. Belcher, Danville, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 622 days.

(21) Appl. No.: 15/058,885

(22) Filed: Mar. 2, 2016

(65) Prior Publication Data

US 2016/0265384 A1 Sep. 15, 2016

Related U.S. Application Data

(60) Provisional application No. 62/131,438, filed on Mar. 11, 2015.

(51) Int. Cl.

| | |
|---|---|
| ***F01D 25/12*** | (2006.01) |
| ***F01D 5/28*** | (2006.01) |
| ***F01D 5/14*** | (2006.01) |
| ***F01D 9/04*** | (2006.01) |

(52) U.S. Cl.

CPC ..... *F01D 25/12* (2013.01); *F01D 5/147* (2013.01); *F01D 5/282* (2013.01); *F01D 5/284* (2013.01); *F01D 9/042* (2013.01); *F01D 5/143* (2013.01); *F05D 2220/32* (2013.01); *F05D 2240/123* (2013.01); *F05D 2240/15* (2013.01); *F05D 2240/81* (2013.01); *F05D 2250/182* (2013.01); *F05D 2260/231* (2013.01); *F05D 2300/6033* (2013.01)

(58) Field of Classification Search

CPC . F01D 5/18; F01D 5/187; F01D 5/188; F01D 25/12

See application file for complete search history.

(56) References Cited

U.S. PATENT DOCUMENTS

| | | | | |
|---|---|---|---|---|
| 4,501,053 | A * | 2/1985 | Craig | B23P 15/04 29/889.721 |
| 4,786,234 | A * | 11/1988 | Readnour | F01D 5/147 415/115 |
| 7,093,359 | B2 | 8/2006 | Morrison et al. | |
| 7,094,021 | B2 * | 8/2006 | Haubert | F01D 5/147 415/115 |
| 7,648,336 | B2 | 1/2010 | Cairo | |
| 7,766,609 | B1 | 8/2010 | Liang | |
| 8,167,573 | B2 | 5/2012 | Merrill et al. | |
| 8,197,211 | B1 | 6/2012 | Liang | |
| 8,206,098 | B2 | 6/2012 | Prill et al. | |
| 8,210,803 | B2 | 7/2012 | Schaff et al. | |

(Continued)

*Primary Examiner* — Jason D Shanske
*Assistant Examiner* — John S Hunter, Jr.
(74) *Attorney, Agent, or Firm* — Barnes & Thornburg LLP

(57) ABSTRACT

A gas turbine engine includes a body and a turbine-vane ring coupled to the body. The turbine-vane ring includes a plurality of turbine-vane assemblies. Each turbine-vane assembly includes a vane unit and a heat shield configured to reduce heat transfer to the vane unit from hot exhaust gases during operation of the gas turbine engine.

16 Claims, 12 Drawing Sheets

(56) References Cited

U.S. PATENT DOCUMENTS

| | | | | |
|---|---|---|---|---|
| 8,371,810 | B2 | 2/2013 | Roberts, III | |
| 8,607,577 | B2 | 12/2013 | Ruberte Sanchez et al. | |
| 8,721,290 | B2 | 5/2014 | Darkins, Jr. et al. | |
| 8,770,931 | B2 | 7/2014 | Alvanos et al. | |
| 8,777,583 | B2 | 7/2014 | Darkins, Jr. et al. | |
| 9,528,382 | B2 * | 12/2016 | Morgan | F01D 5/147 |
| 2011/0110771 | A1 * | 5/2011 | Morgan | F01D 5/147<br>415/177 |
| 2011/0305580 | A1 | 12/2011 | Wilson, Jr. et al. | |
| 2012/0301312 | A1 | 11/2012 | Berczik et al. | |

* cited by examiner

B-B

TURBINE VANE WITH HEAT SHIELD

CROSS REFERENCE TO RELATED APPLICATIONS

This application claims priority to and the benefit of U.S. Provisional Patent Application No. 62/131,438, filed 11 Mar. 2015, the disclosure of which is now expressly incorporated herein by reference.

FIELD OF THE DISCLOSURE

The present disclosure relates generally to gas turbine engines, and more specifically to airfoil units with heat shields used with gas turbine engines.

BACKGROUND

A turbine gas engine includes a compressor, a combustor, and a turbine. The turbine extracts work from the hot, pressurized gas created by the compressor and combustor to drive the compressor. The turbine includes alternating rotating disks and stationary vane rings. The hot, pressurized gas causes the rotation disks to rotate and flow past the vane rings. The hot pressurized gas may distort and damage components included in the rotating disks and stationary vane rings.

SUMMARY

The present disclosure may comprise one or more of the following features and combinations thereof.

A turbine gas engine may include a body and a turbine-vane ring coupled to the body. The turbine-vane ring may include a plurality of turbine-vane assemblies. In an embodiment, a turbine-vane assembly may include a vane unit and a heat shield. A vane unit may include an inner flange, an outer flange located in spaced-apart radial relation to the inner flange, and a vane extending between and interconnecting the inner and outer flanges. A heat shield may include an inner-flange shield coupled to the inner flange in a fixed position relative to the inner flange, an outer-flange shield coupled to the outer flange in a fixed position relative to the outer flange, and a vane shield coupled to the vane in a fixed position relative to the vane and arranged to extend between and interconnect the inner and outer flange shields.

In some embodiments, the heat shield may comprise ceramic matrix composite.

In some embodiments, the vane shield may be joined to the inner-flange shield by a first co-processing bond and the vane shield may be joined to the outer-flange shield by a second co-processing bond.

In some embodiments, the vane shield may be located on a pressure side of the vane.

In some embodiments, the inner-flange shield may be in spaced-apart relation to the inner flange, the vane shield may be in spaced-apart relation to the pressure side of the vane, and the outer-flange shield may be in spaced-apart relation to the outer flange.

In some embodiments, the vane shield may include a vane shield body and a vane shield inner-flange edge and the vane shield inner-flange edge may be located at the first co-processing bond and may comprise a first plurality of teeth.

In some embodiments, the inner-flange shield may include an inner-flange shield body and an inner-flange shield vane edge and the inner-flange shield vane edge may be located at the first co-processing bond and may comprise a second plurality of teeth.

In some embodiments, the first plurality of teeth and the second plurality of teeth may be configured to fit together.

In some embodiments, the first plurality of teeth and the second plurality of teeth may be substantially rectangular.

In some embodiments, the vane shield may include a vane shield body, a vane shield inner-flange edge, and a first vane shield tab extending from the vane shield inner-flange edge.

In some embodiments, the inner-flange shield may include an inner-flange shield body, an inner-flange shield vane edge, and an inner-flange shield tab extending from the inner-flange shield vane edge.

In some embodiments, a first cavity formed in the first vane shield tab and a second cavity formed in the inner-flange shield tab may be aligned and configured to receive a pin.

In some embodiments, the first co-processing bond is located at the intersection of the cavities and the pin.

In some embodiments, the vane shield may include a vane shield body, a vane shield inner-flange edge, and a first vane shield lip extending between the vane shield body and the vane shield inner-flange edge.

In some embodiments, the first vane shield lip may be thicker than the vane shield inner-flange edge. The first vane shield lip may be thicker than a portion of the vane shield body.

In some embodiments, the inner-flange shield may include an inner-flange shield body and an inner-flange shield vane edge.

In some embodiments, the inner-flange shield vane edge may engage the vane shield inner-flange edge and the first vane shield lip.

In some embodiments, the first co-processing bond may be located at the intersection of the inner-flange shield vane edge and the vane shield inner-flange edge and at the intersection of the first vane shield lip and the inner-flange shield vane edge.

In some embodiments, the inner-flange shield may include an inner-flange shield body, an inner-flange shield vane edge, and an inner-flange shield lip extending between the inner-flange shield body and the inner-flange shield vane edge.

In some embodiments, the inner-flange shield lip may be thicker than the inner-flange shield vane edge.

In some embodiments, the vane shield may include a vane shield body and a vane shield inner-flange edge.

In some embodiments, the vane shield inner-flange edge may engage the inner-flange shield vane edge and the inner-flange shield lip.

In some embodiments, the first co-processing bond may be located at the intersection of the vane shield inner-flange edge and the inner-flange shield vane edge and at the intersection of the inner-flange shield lip and the vane shield inner-flange edge.

In some embodiments, the vane shield may include a vane shield body, a vane shield inner-flange edge, and a first plurality of cavities formed in the vane shield body.

In some embodiments, the inner-flange shield may include an inner-flange shield body and an inner-flange shield vane edge.

In some embodiments, the first plurality of cavities may be formed in the vane shield body are each configured to receive a pin.

In some embodiments, the pins may engage the vane shield edge, the vane shield body, and the inner-flange shield vane edge.

In some embodiments, a plurality of fairings may engage the vane shield body, the inner-flange shield vane edge, and at least one of the pins.

In some embodiments, the first co-processing bond may be located at the intersection of the pins and the vane shield body, the intersection of the pins and the vane shield inner-flange edge, the intersection of the pins and the inner-flange shield vane edge, the intersection of the pins and the plurality of fairings, the intersection of the plurality of fairings and the vane shield body, and the intersection of the plurality of fairings and the inner-flange shield vane edge.

In some embodiments, the vane shield may be located in spaced-apart relation to the vane to define a first passage therebetween.

In some embodiments, the turbine-vane assembly may include a plurality of spacing nubs located between the vane shield and the vane.

In some embodiments, the spacing nubs may extend from the vane toward the vane shield.

In some embodiments, the spacing nubs may extend from the vane shield toward the vane.

In some embodiments, cooling air may be configured to pass through the first passage.

In some embodiments, the inner flange may be located in spaced-apart relation to the inner-flange shield to define a second passage therebetween.

In some embodiments, cooling air may be configured to pass through the second passage.

In some embodiments, the outer flange may be located in spaced-apart relation to the outer-flange shield to define a third passage therebetween.

In some embodiments, cooling air may be configured to pass through the third passage.

In some embodiments, the inner flange, the vane, and the outer flange may include a plurality of spacing nubs extending from the inner flange, the vane, and the outer flange to the heat shield.

In some embodiments, the heat shield may comprise ceramic matrix composite. The heat shield may include a plurality of spacing nubs extending from the heat shield to the inner flange, the vane, and the outer flange.

According to another aspect of the present disclosure, a turbine-vane ring may be used in a gas-turbine engine. The turbine-vane ring may include a first turbine-vane assembly including a first vane unit including an inner flange, an outer flange located in spaced-apart radial relation to the inner flange, and a vane extending between and interconnecting the inner and outer flanges and a first heat shield including an inner-flange shield coupled to the inner flange in a fixed position relative to the inner flange, an outer-flange shield coupled to the outer flange in a fixed position relative to the outer flange, and a vane shield coupled to the vane in a fixed position relative to the vane and arranged to extend between and interconnect the inner and outer flange shields and a second turbine-vane assembly including a second vane unit including an inner flange, an outer flange located in spaced-apart radial relation to the inner flange, and a vane extending between and interconnecting the inner and outer flanges and a second heat shield including an inner-flange shield coupled to the inner flange in a fixed position relative to the inner flange, an outer-flange shield coupled to the outer flange in a fixed position relative to the outer flange, and a vane shield coupled to the vane in a fixed position relative to the vane and arranged to extend between and interconnect the inner and outer flange shields, wherein the first inner-flange shield is arranged to extend between and interconnect the first vane and the second vane.

In some embodiments, the first inner-flange shield may include a forward strip coupled to a forward edge to extend axially away from the vane, an aft strip to locate the flange shield therebetween. An inner portion may be coupled to the first vane shield and extend between the forward strip and the aft strip, an outer portion that extends to the second turbine-assembly, and a middle portion located between the inner portion and the outer portion.

In some embodiments, the second inner-flange shield may include a forward strip coupled to a forward edge to extend axially away from the vane, an aft strip to locate the flange shield therebetween. An inner portion may be coupled to the first vane shield and extending between the forward strip and the aft strip, an outer portion that extends to the second turbine-assembly, and a middle portion located between the inner portion and the outer portion.

In some embodiments, the vane of the second vane unit may include a vane having an inner-flange end, an outer-flange end and a vane body connected therebetween. The vane may be formed to include a recess extending from the vane body toward the inner-flange end and the first inner-flange shield extends into the recess of the vane of the second vane unit.

In some embodiments, the outer portion of the first inner-flange shield may have a curved edge.

In some embodiments, the first inner-flange shield may include a retention tab coupled to the forward strip and the vane shield.

According to another aspect of the present disclosure, a heat shield may include a vane shield and an inner-flange shield. A first joint between the inner-flange shield and the vane shield is approximately perpendicular, wherein the heat shield comprises ceramic matrix composite. The vane shield may be joined to the inner-flange shield by co-processing.

In some embodiments, the heat shield may further include an outer-flange shield. A second joint between the inner-flange shield and the vane shield may be approximately perpendicular. The vane shield may be joined to the outer-flange shield by co-processing.

In some embodiments, the heat shield may further include a plurality of spacing nubs. The spacing nubs may extend from the heat shield such that when inserted in a turbine-vane assembly, the spacing nubs separate the outer-flange shield from an outer flange, the spacing nubs separate the inner-flange shield from an inner flange, and the spacing nubs separate the vane shield from a vane.

In some embodiments, the outer flange, the inner flange, and the vane may further include a plurality of spacing nubs. The spacing nubs may extend from the outer flange, the inner flange, and the vane such that when the heat shield is inserted in a turbine-vane assembly, the spacing nubs separate the outer-flange shield from an outer flange, the spacing nubs separate the inner-flange shield from an inner flange, and the spacing nubs separate the vane shield from a vane.

In some embodiments, the heat shield may be inserted in a turbine-vane assembly, the inner-flange shield may extend into a first recess formed between an inner flange of a turbine-vane assembly and an adjacent vane and the outer-flange shield may extend into a second recess formed between an outer flange of the turbine-vane assembly and the adjacent vane.

In some embodiments, the spacing nubs may extend from the outer flange, the inner flange, and the vane such that when the heat shield is inserted in a turbine-vane assembly the spacing nubs may separate the outer-flange shield from the outer flange, the spacing nubs may separate the inner-flange shield from the inner flange, and the spacing nubs may separate the vane shield from a vane.

In some embodiments, the spacing nubs may extend from the heat shield such that when inserted in a turbine-vane assembly the spacing nubs may separate the outer-flange shield from the outer flange, the spacing nubs may separate the inner-flange shield from the inner flange, and the spacing nubs may separate the vane shield from a vane.

These and other features of the present disclosure will become more apparent from the following description of the illustrative embodiments.

DETAILED DESCRIPTION OF THE DRAWINGS

Figure 1:
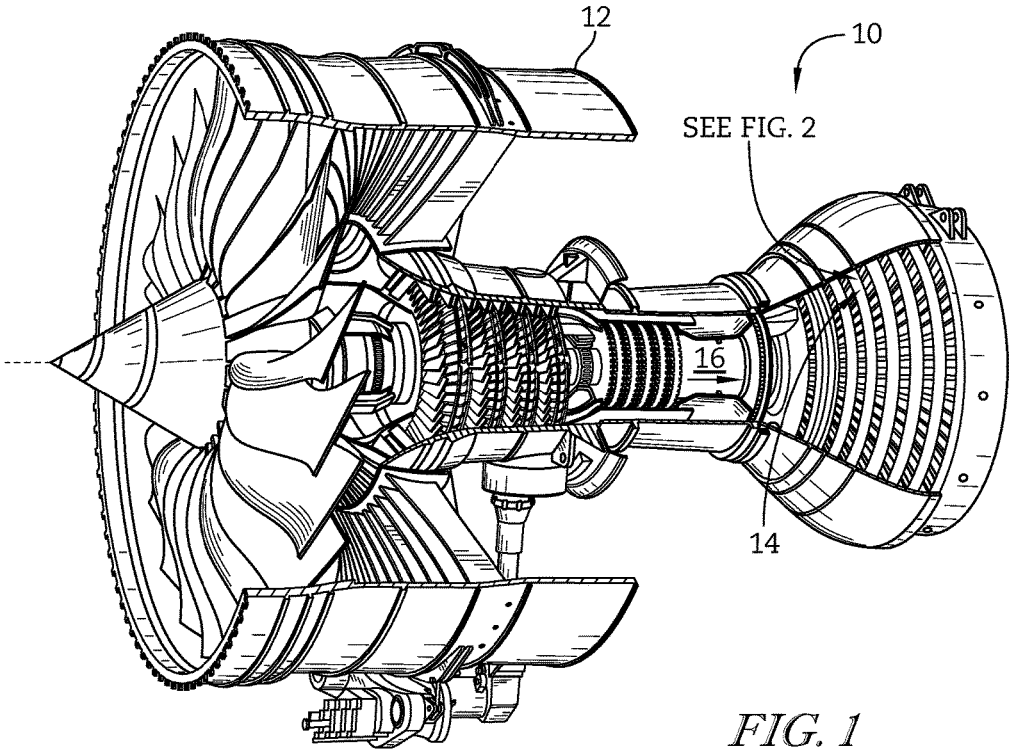
FIG. 1 is a cutaway view of a gas turbine engine including a turbine for extracting work from hot high-pressure products to power a fan assembly and a compressor included in the engine and showing that the turbine includes a turbine-vane ring comprising a plurality of turbine-vane assemblies, with each turbine-vane assembly including a vane unit and a heat shield.

For the purposes of promoting an understanding of the principles of the disclosure, reference will now be made to a number of illustrative embodiments illustrated in the drawings and specific language will be used to describe the same.

Figure 2:
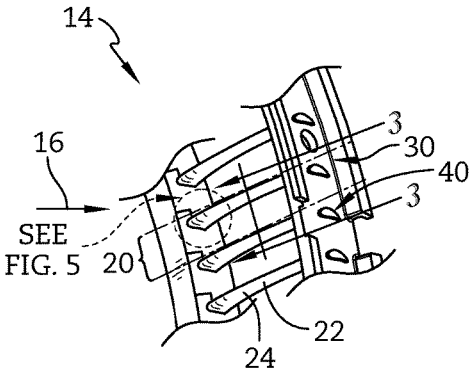
FIG. 2 is a cutaway view of a portion of the turbine-vane ring included in the gas turbine engine of FIG. 1 showing a few vane assemblies, each comprising a vane unit including an inner flange, an outer flange located in spaced-apart radial relation to the inner flange, and a vane extending between and interconnecting the inner and outer flanges and a heat shield including an inner-flange shield, an outer-flange shield, and a vane shield on a pressure side of the vane.
Figure 3:
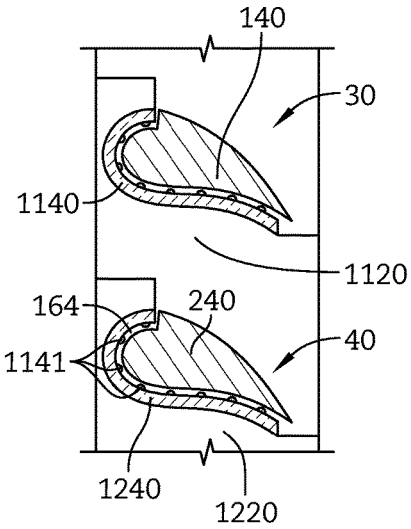
FIG. 3 is a sectional view taken along line 3-3 of FIG. 2 showing two vanes, two vane shields, portions of three inner-flange shields, and a plurality of spacing nubs extending toward the vanes to maintain the vane shields in spaced-apart relation to the respective vanes.

A turbine gas engine 10 in accordance with the present disclosure includes a body 12 and a turbine-vane ring 14 as shown in FIG. 1. As suggested by FIG. 2, the turbine-vane ring 14 includes a plurality of turbine-vane assemblies 30, 40 each having a vane unit 22 and a heat shield 24. During operation of the turbine gas engine 10, each of the heat shields 24 reduces heat transfer to each of the vane units 22 from a hot exhaust gas 16 as it passes between each pair of neighboring turbine-vane assemblies 30, 40.

Figure 4:
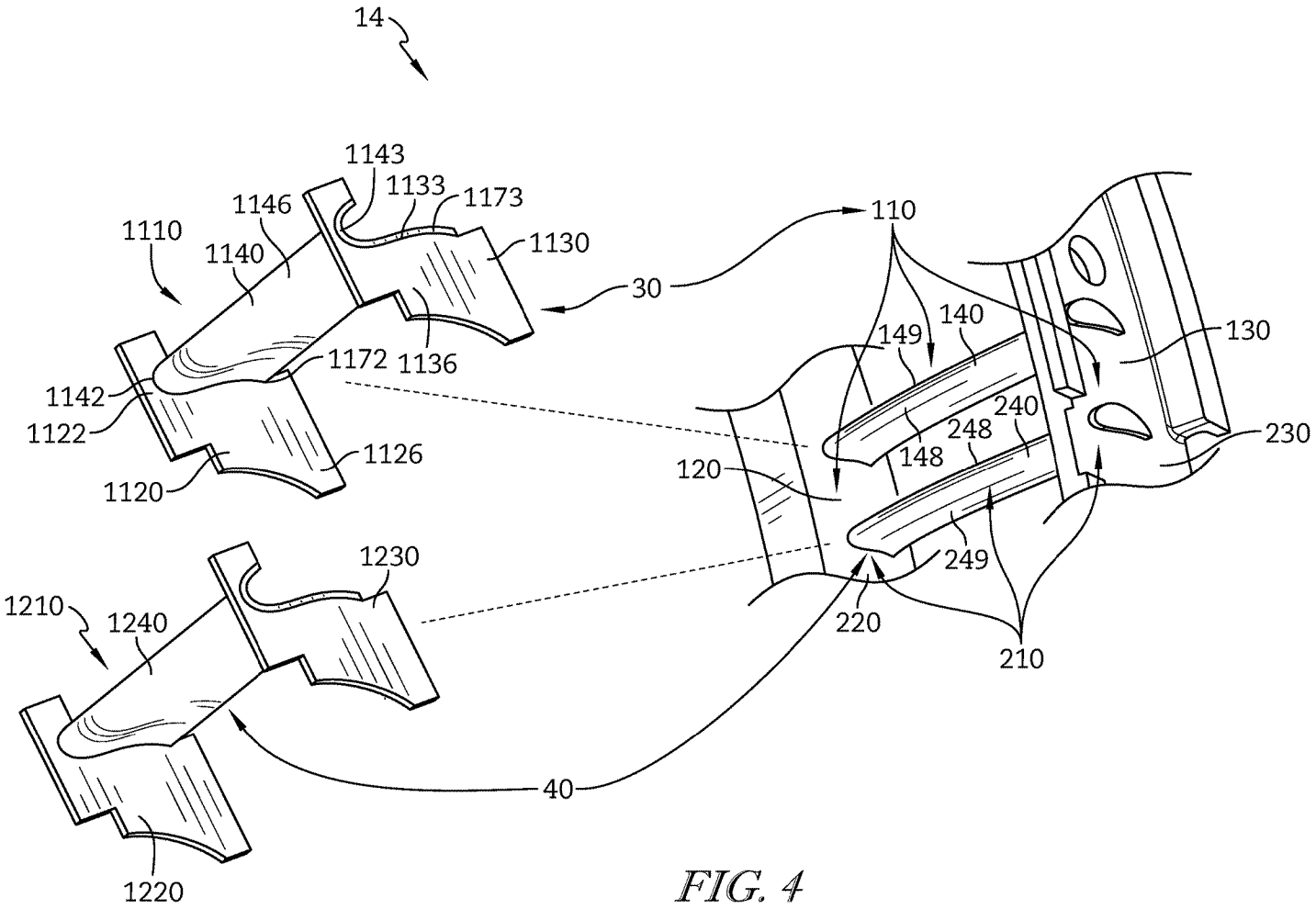
FIG. 4 is an exploded assembly view of a portion of FIG. 2 showing, from left to right, first and second heat shields spaced apart from associated first and second vane units.
Figure 5:
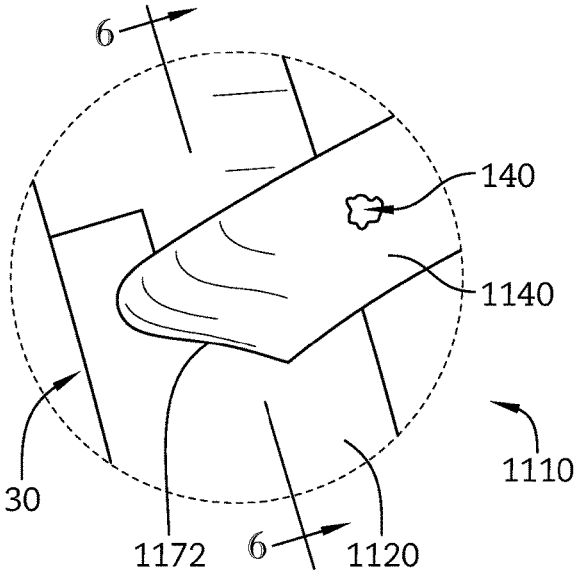
FIG. 5 is an enlarged view taken from the circled region of FIG. 2 showing a first heat shield including a vane shield and an inner-flange shield, a vane coupled to the vane shield, and a second heat shield having an inner-flange shield adjacent to the inner-flange shield of the first heat shield.
Figure 6:
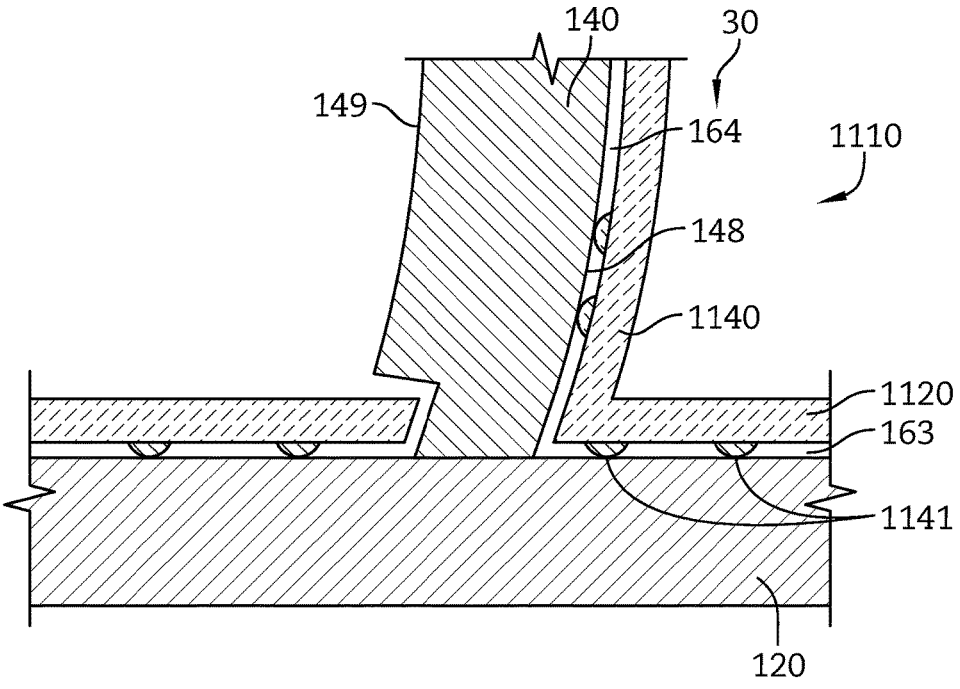
FIG. 6 is a sectional view taken along line 6-6 of FIG. 5 showing the vane having a suction side and a pressure side, an inner flange, the inner-flange shield of the second heat shield arranged to extend into a recess formed in the suction side of the vane, the first heat shield including the vane shield coupled to the pressure side of the vane and the inner-flange shield appended to the vane shield, and a plurality of spacing nubs extending from the heat shields toward associated vane units into passages formed between the vane units and the heat shields.

The turbine-vane ring 14 includes a first turbine-vane assembly 30 and a second turbine-vane assembly 40 as shown in FIG. 4. The first turbine-vane assembly 30 includes a first vane unit 110 and a first heat shield 1110. The first vane unit includes an inner flange 120, an outer flange 130 located in spaced-apart radial relation to the inner flange 120, and a vane 140 extending between and interconnecting the inner flange 120 and the outer flange 130. As shown by FIG. 6, the vane 140 includes a pressure side 148 and a suction side 149. In use, hot exhaust gas 16 engages pressure side 148 and flows around pressure side 148 in spaced-apart relation to suction side 149.

As shown in FIG. 4, the heat shield 1110 includes an inner-flange shield 1120, an outer-flange shield 1130, and a vane shield 1140 arranged to extend between and interconnect the inner-flange shield 1120 and the outer-flange shield 1130. As suggested in FIG. 4, the heat shield 1110 of the first turbine vane assembly 30 is inserted into the vane unit 110 of the first turbine vane assembly 30 such that the inner-flange shield 1120 is coupled to the inner flange 120 in a fixed position relative to the inner flange 120, the outer-flange shield 1130 is coupled to the outer flange 130 in a fixed position relative to the outer flange 130, and the vane shield 1140 is coupled to the pressure side 148 of the vane 140 in a fixed position relative to the vane 140. The second turbine-vane assembly 40 includes a second vane unit 210 and a second heat shield 1210. The second vane unit includes an inner flange 220, an outer flange 230 located in spaced-apart radial relation to the inner flange 220, and a vane 240 extending between and interconnecting the inner flange 220 and the outer flange 230. The vane 240 includes a pressure side 248 and a suction side 249.

As shown by FIG. 4, the heat shield 1210 includes an inner-flange shield 1220, an outer-flange shield 1230, and a vane shield 1240 arranged to extend between and interconnect the inner-flange shield 1220 and the outer-flange shield 1230. As suggested by FIG. 4, the heat shield 1210 of the first turbine vane assembly 40 is inserted into the vane unit 210 of the first turbine vane assembly 40 such that the inner-flange shield 1220 is coupled to the inner flange 220 in a fixed position relative to the inner flange 220, the outer-flange shield 1230 is coupled to the outer flange 230 in a fixed position relative to the outer flange 230, and the vane shield 1240 is coupled to the pressure side 248 of the vane 240 in a fixed position relative to the vane 240.

Figure 7:
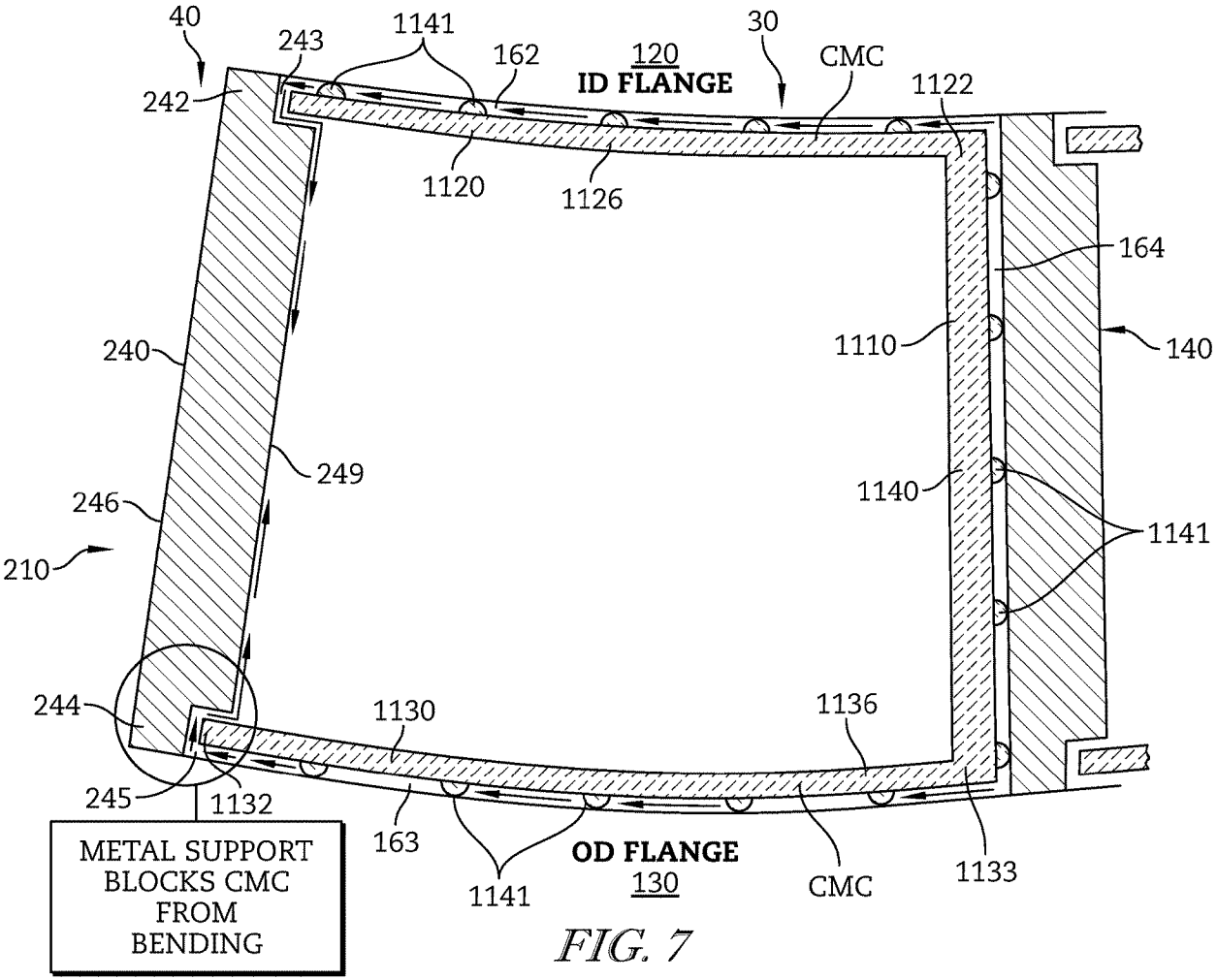
FIG. 7 is a diagrammatic view of two turbine-vane assemblies in accordance with present disclosure showing how cooling air (single solid arrow) is arranged to flow through the passages formed between mating vane units and heat shields and around spacing nubs to cool portions of the vane units during operation of the gas turbine engine.

The vane 240 of second vane unit 210 includes an inner-flange end 242, an outer-flange end 244, and a vane body 246 extending between and interconnecting the inner-flange end 242 and the outer-flange end 244 as shown in FIG. 7. A first recess 243 is formed in the vane body 246 and arranged to extend toward the inner-flange end 242. The first recess 243 is formed on the suction side 249 of the vane 240. The inner-flange shield 1120 of the first heat shield 1110 includes an inner-flange shield vane edge 1122 coupled to the vane shield 1140 and an inner-flange shield body 1126. The inner-flange shield body 1126 extends from the inner-flange shield vane edge 1122 into the first recess 243.

A second recess 245 is formed in the suction side 249 of the vane body 246 of the vane 240 and is arranged to extend from the vane body 246 toward the outer-flange end 244. The outer-flange shield 1130 includes an outer-flange shield vane edge 1133 coupled to the vane shield 1140 and an outer-flange shield body 1136. The outer-flange shield body 1136 extends from the outer-flange shield vane edge 1133 into the second recess 245.

The vane shield 1140 is located in spaced-apart relation to the vane 140 to define a first passage 164 therebetween as shown in FIG. 7. The inner-flange shield 1120 is located in spaced-apart relation to the inner flange 120 to define a second passage 162 therebetween as shown in FIG. 7. The outer-flange shield 1130 is located in spaced-apart relation to the outer flange 130 to define a third passage 163 therebetween as shown in FIG. 7.

In an embodiment, the first heat shield 1110 includes a plurality of spacing nubs 1141. The plurality of spacing nubs 1141 extend from the vane shield 1140 to the vane 140 as shown in FIG. 7. The plurality of nubs 1141 also extend from the inner-flange shield 1120 to the inner flange 120 as shown in FIG. 7. The plurality of nubs 1141 also extend from the outer-flange shield 1130 to the outer flange 130 as shown in FIG. 7. In an embodiment, the plurality of spacing nubs 1141 also extend from the inner-flange shield 1120 to the vane 240 of the second vane unit 210. The plurality of spacing nubs 1141 also extend from the outer-flange shield 1130 to the vane 240 of the second vane unit 210.

High pressure cooling air may move through at least one of the passages 162, 163, 164 as shown in FIG. 7. The high pressure cooling air passes around the plurality of spacing nubs 1141 extending into the passages 162, 163, 164. The flow of the high pressure cooling air through the second passage 162 may enter a flow path of the hot exhaust gas of the vane unit 110. In one example, the high pressure cooling air may exert a bending force on the inner-flange shield 1120. The vane body 246 resists the bending force on the inner-flange shield 1120. The flow of the high pressure cooling air through the third passage 163 may enter a flow path of the hot exhaust gas. In one example, the high pressure cooling air may exert a bending force on the outer-flange shield 1130. As shown in the circled region of FIG. 7, the vane body 246 extends above an outer-flange shield vane edge 1132 of the outer-flange shield 1130. The vane body 246 resists the bending force on the outer-flange shield 1130.

The first heat shield 1110 comprises ceramic matrix composite. In one example, the inner-flange shield 1120, the outer-flange shield 1130, and the vane shield 1140 may be produced separately and subsequently coupled together and bonded by co-processing. The inner-flange shield 1120 and the vane shield 1140 may be coupled at a right angle by co-processing at a first co-processing bond 1172. The outer-flange shield 1130 and the vane shield 1140 may be coupled at a right angle by co-processing at a second co-processing bond 1173.

The vane shield 1140 includes a vane shield body 1146 and a vane shield inner-flange edge 1142 and the vane shield inner-flange edge 1142 is located at the first co-processing bond 1172. The inner-flange shield 1120 includes an inner-flange shield body 1126 and an inner-flange shield vane edge 1122 and the inner-flange shield vane edge 1122 is located at the first co-processing bond 1172. The vane shield inner-flange edge 1142 and the inner-flange shield vane edge 1122 are configured to fit together without a significant gap between the vane shield inner-flange edge 1142 and the inner-flange shield vane edge 1122. The vane shield inner-flange edge 1142 and the inner-flange shield vane edge 1122 may have a variety of shapes. The present disclosure contemplates a variety of shapes inspired by wood-working to join the vane shield inner-flange edge 1142 and the inner-flange shield vane edge 1122.

The vane shield 1140 includes a vane shield body 1146 and a vane shield outer-flange edge 1143 and the vane shield outer-flange edge 1143 is located at the second co-processing bond 1173. The outer-flange shield 1130 includes an outer-flange shield body 1136 and an outer-flange shield vane edge 1133 and the outer-flange shield vane edge 1133 is located at the second co-processing bond 1173. The vane shield outer-flange edge 1143 and the outer-flange shield vane edge 1133 are configured to fit together without a significant gap between the vane shield outer-flange edge 1143 and the outer-flange shield vane edge 1133. The vane shield outer-flange edge 1143 and the outer-flange shield vane edge 1133 may have a variety of shapes.

The heat shield 1110 may be produced by depositing a quantity of ceramic matrix onto separate fiber preforms of the vane shield 1140, the inner-flange shield 1120, and the outer-flange shield 1130 through chemical vapor infiltration. The vane shield 1140, the inner-flange shield 1120, and the outer-flange shield 1130 may then undergo mechanical preparation of joining features and interfaces and then be assembled into substantially the desired orientation.

After the mechanical preparation of joining features and interfaces, the vane shield inner-flange edge 1142 and the inner-flange shield vane edge 1122 may be coupled together. Final joining of the heat shield 1110 may be then be achieved by one of or both a slurry infiltration process and a melt infiltration process. The slurry infiltration process, the melt infiltration process, or both may join the vane shield inner-flange edge 1142 and the inner-flange shield vane edge 1122 at the first co-processing bond 1172. The slurry infiltration process, the melt infiltration process, or both may also join the vane shield outer-flange edge 1143 and the outer-flange shield vane edge 1133 at the second co-processing bond 1173.

In another example, a heat shield may be produced using a single fiber preform comprising a vane shield, an inner-flange shield, and an outer-flange shield and depositing a ceramic matrix onto the preform. The ceramic matrix may be deposited through a means of chemical vapor infiltration, slurry infiltration, and melt infiltration. As a result, the inner-flange shield, the outer-flange shield, and the van shield would be formed integrally. In this embodiment, there would be no need to join the vane shield and the inner-flange and outer-flange shields through a co-processing bond or other means to form the heat shield.

In an embodiment, a heat shield of a first turbine vane assembly is inserted into a vane unit of the first turbine vane assembly such that an inner-flange shield is coupled to an inner flange in a fixed position relative to the inner flange, an outer-flange shield is coupled to an outer flange in a fixed position relative to the outer flange, and a vane shield is coupled to the suction side of the vane in a fixed position relative to the vane.

An adjacent vane includes a vane body, an inner-flange end, and an outer-flange end. A first recess is formed in the vane body and arranged to extend toward the inner-flange end. The first recess is formed on the pressure side of the adjacent vane. The inner-flange shield includes an inner-flange shield vane edge coupled to the vane shield and an inner-flange shield body. The inner-flange shield body extends from the inner-flange shield vane edge into the first recess.

A second recess is formed in the vane body and arranged to extend toward the outer-flange end. The second recess is formed on the pressure side of the adjacent vane. The outer-flange shield includes an outer-flange shield vane edge coupled to the vane shield and an outer-flange shield body. The outer-flange shield body extends from the outer-flange shield vane edge into the second recess.

In an embodiment, a vane, an inner flange, and an outer flange include a plurality of spacing nubs. The plurality of spacing nubs extend from the vane, the inner flange, and the outer flange toward a heat shield. In an embodiment, an adjacent vane also includes a plurality of spacing nubs that extend from the adjacent vane to an inner-flange shield of the heat shield. The plurality of spacing nubs of the adjacent vane also extends from the adjacent vane to an outer-flange shield of the heat shield.

Figure 8:
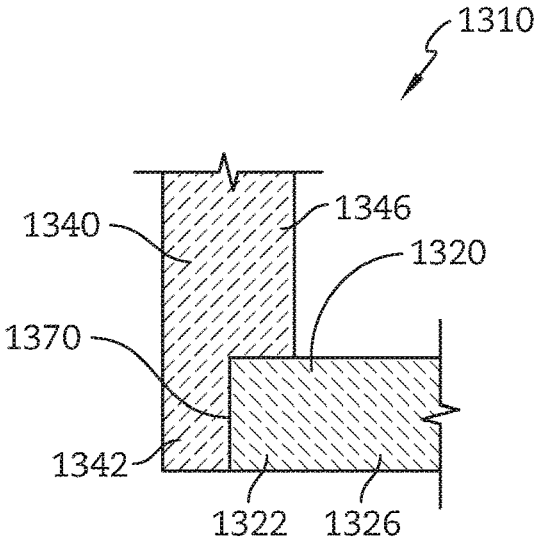
FIG. 8 is a diagrammatic view of a first embodiment of a joint formed between a vane shield and a flange shield and suggesting that the vane shield and the flange shield are coupled together by a co-processing bond.

Another embodiment of a heat shield 1310 in accordance with the present disclosure is shown in FIG. 8. The heat shield 1310 includes a vane shield 1340, a flange shield 1320, and a co-processing bond 1370. The vane shield 1340 includes a vane shield body 1346 and a vane shield flange edge 1342. The flange shield 1320 includes a flange shield body 1326 and a flange shield vane edge 1322. The vane shield 1340 is formed to include a recess extending from the vane shield body 1346 toward the vane shield flange edge 1342. The flange shield vane edge 1322 extends into the recess of the vane shield 1340. The vane shield 1340 and the flange shield 1320 are co-processed together to form the co-processing bond 1370.

Figure 9:
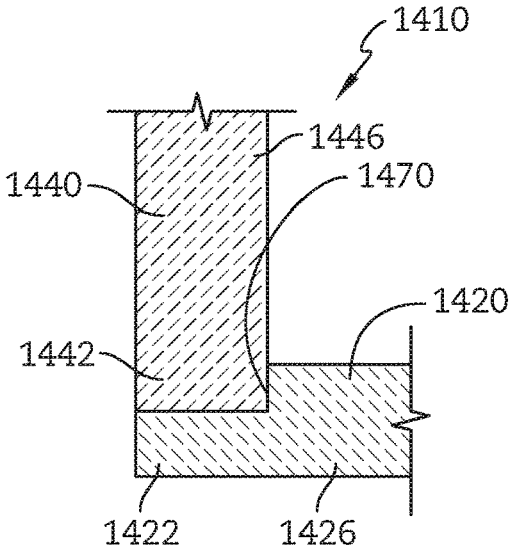
FIG. 9 is a diagrammatic view of a second embodiment of a joint formed between a vane shield and a flange shield and suggesting that the vane shield and flange shield are coupled together by a co-processing bond.

Another embodiment of a heat shield 1410 in accordance with the present disclosure is shown in FIG. 9. The heat shield 1410 includes a vane shield 1440, a flange shield 1420, and a co-processing bond 1470. The vane shield 1440 includes a vane shield body 1446 and a vane shield flange edge 1442. The flange shield 1420 includes a flange shield body 1426 and a flange shield vane edge 1422. The flange shield 1420 is formed to include a recess extending from the flange shield body 1426 toward the flange shield vane edge 1422. The vane shield flange edge 1442 extends into the recess of the flange shield 1420. The vane shield 1440 and the flange shield 1420 are co-processed together to form the co-processing bond 1470.

Figure 10:
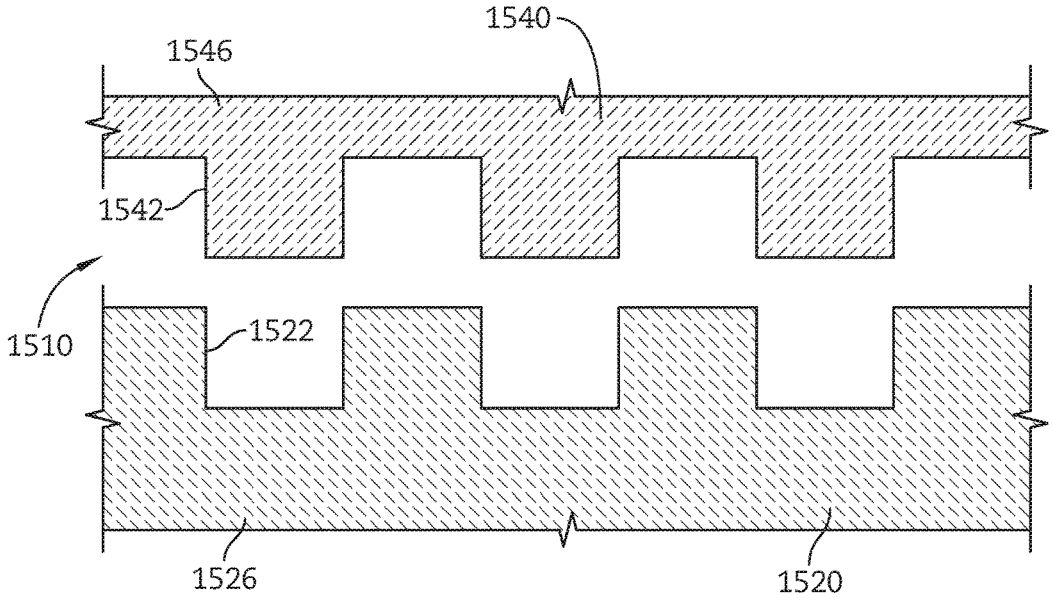
FIG. 10 is an exploded diagrammatic view of a first embodiment of a finger joint formed when a vane shield is coupled to a flange shield.

Another embodiment of a heat shield 1510 in accordance with the present disclosure is shown in FIG. 10. The heat shield 1510 includes a vane shield 1540 and a flange shield 1520. The vane shield 1540 includes a vane shield body 1546 and a vane shield flange edge 1542. The flange shield 1520 includes a flange shield body 1526 and a flange shield vane edge 1522. The vane shield 1540 is formed to include a plurality of recesses extending from the vane shield body 1546 toward the vane shield flange edge 1542. The flange shield 1520 is formed to include a plurality of recesses extending from the flange shield body 1526 toward the flange shield vane edge 1522. As suggested by FIG. 10, the flange shield vane edge 1522 and the vane shield flange edge 1542 may be coupled together without forming a significant gap. Once coupled, the flange shield vane edge 1522 and the vane shield flange edge 1542 may be co-processed together.

Figure 11A:
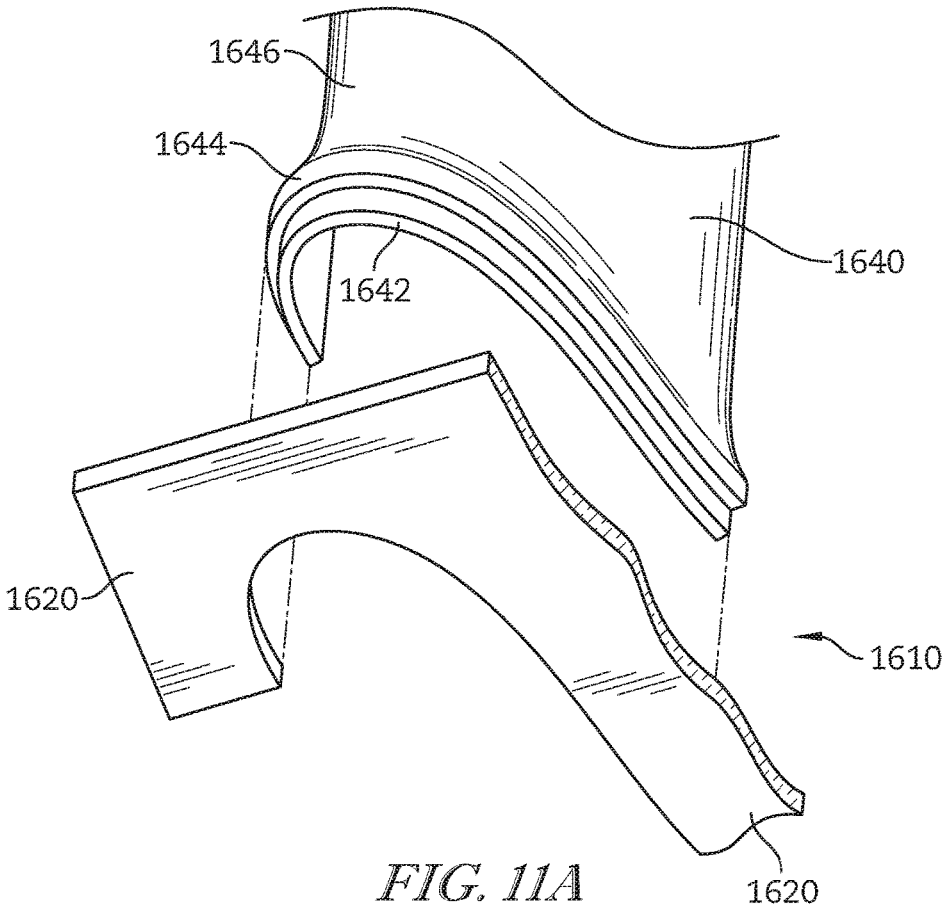
FIG. 11A is a diagrammatic view of another embodiment of a heat shield in accordance with the present disclosure showing that a vane shield included in the heat shield includes an inner-flange end having a thickened lip which mates with an inner-flange heat shield as suggested in FIG. 11B.
Figure 11B:
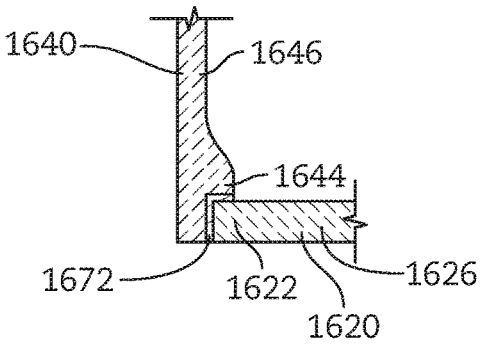
FIG. 11B is a diagrammatic view of a constructed joint formed between the vane shield and the inner-flange shield of FIG. 11A showing the thickened lip extends over the inner-flange shield causing a co-processing bond formed between the vane shield and the inner-flange shield to be lengthened.

Another embodiment of a heat shield 1610 in accordance with the present disclosure is shown in FIG. 11A. The heat shield 1610 includes a vane shield 1640 and an inner-flange shield 1620 as shown in FIG. 11A. The vane shield 1640 includes a vane shield body 1646, a vane shield inner-flange edge 1642, and a first vane shield lip 1644 extending between the vane shield body 1646 and the vane shield inner-flange edge 1642. The first vane shield lip 1644 is thicker than the vane shield inner-flange edge 1642. The first vane shield lip 1644 is thicker than at least a portion of the vane shield body 1646. As shown in FIG. 11B, the inner-flange shield 1620 includes an inner-flange shield body 1626 and an inner-flange shield vane edge 1622. The inner-flange shield vane edge 1622 engages the vane shield inner-flange edge 1642 and the first vane shield lip 1644. A first co-processing bond 1672 is located at the intersection of the inner-flange shield vane edge 1622 and the vane shield inner-flange edge 1642 and at the intersection of the first vane shield lip 1644 and the inner-flange shield vane edge 1622.

Figure 12A:
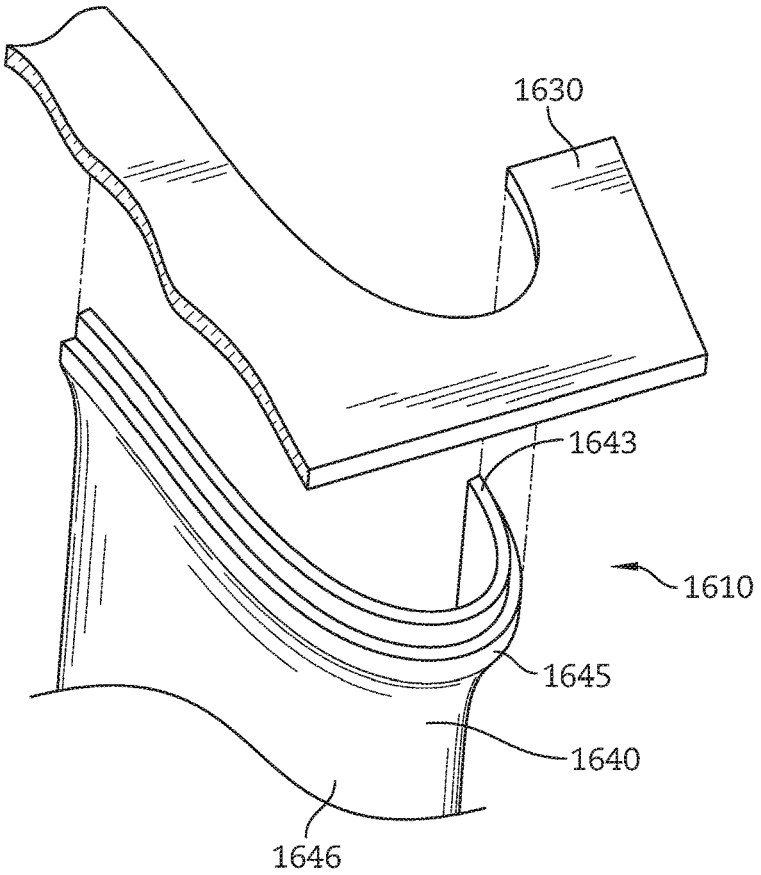
FIG. 12A is an exploded view similar to FIG. 11A showing an outer-flange shield included in the heat shield and an outer-flange end of the vane shield having a thickened lip which mates with the outer-flange shield as suggested in FIG. 12B.
Figure 12B:
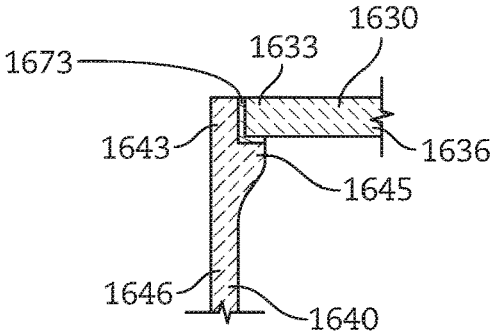
FIG. 12B is a diagrammatic view of a constructed joint formed between the vane shield and the outer-flange shield of FIG. 12A showing the thickened lip extends over the outer-flange shield causing a co-processing bond formed between the vane shield and the outer-flange shield to be lengthened.

The heat shield 1610 further includes an outer-flange shield 1630, as shown in FIG. 12A. The vane shield 1640 further includes a vane shield outer-flange edge 1643 and a second vane shield lip 1645 extending between the vane shield body 1646 and the vane shield outer-flange edge 1643. The second vane shield lip 1645 is thicker than the vane shield outer-flange edge 1643. The second vane shield lip 1645 is thicker than at least a portion of the vane shield body 1646. As shown in FIG. 12B, the outer-flange shield 1630 includes an outer-flange shield body 1636 and an outer-flange shield vane edge 1633. The outer-flange shield vane edge 1633 engages the vane shield outer-flange edge 1643 and the second vane shield lip 1645. A second co-processing bond 1673 is located at the intersection of the outer-flange shield vane edge 1633 and the vane shield outer-flange edge 1643 and at the intersection of the second vane shield lip 1645 and the outer-flange shield vane edge 1633.

Figure 13A:
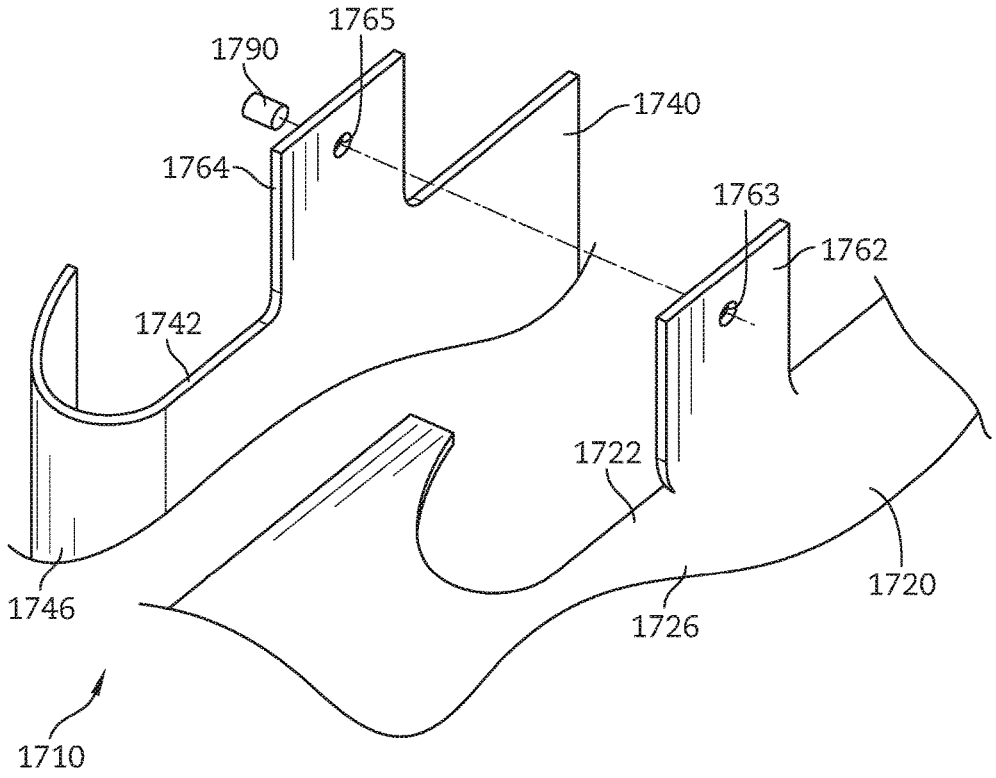
FIG. 13A is diagrammatic view of another embodiment of heat shield in accordance with the present disclosure showing a portion of a vane shield included in the heat shield, a portion of a flange shield included in the heat shield, and a connecting pin arranged to extend through aligned holes formed in tabs associated with the vane shield and the flange shield to couple the vane shield to the flange shield as suggested in FIG. 13B.

Another embodiment of a heat shield 1710 in accordance with the present disclosure is shown in FIG. 13A. The heat shield 1710 includes a vane shield 1740, a flange shield 1720, and a pin 1790. The flange shield 1720 includes a flange shield body 1726, a flange shield vane edge 1722, a flange shield tab 1762 extending from the flange shield vane edge 1722. The flange shield tab 1762 is formed to include a recess 1763.

Figure 13B:
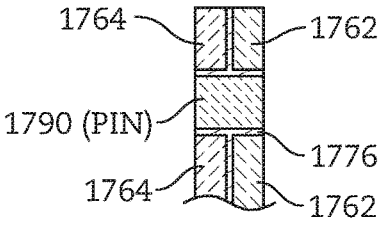
FIG. 13B is a diagrammatic view of a constructed joint formed between the vane shield and the flange shield of FIG. 13A showing that a co-processing bond is formed between the pin and the tabs of the vane shield and the flange shield.

The vane shield 1740 includes a vane shield body 1746, a vane shield flange edge 1742, a vane shield tab 1764 extending from the vane shield flange edge 1742. The vane shield tab 1764 is formed to include a recess 1765. The flange shield tab 1762 engages the flange shield tab 1764. The recesses 1763, 1765 are configured to engage and receive the pin 1790 therein. The pin 1790 may be cylindrical, as shown in FIG. 13A. The pin 1790 may be comprised of the same material as the rest of the heat shield 1710. The pin 1790 may be comprised of ceramic matrix composite. A first co-processing bond is located at the intersection of the flange shield vane edge 1722 and the vane shield flange edge 1742. As shown in FIG. 13B, a tab co-processing bond 1776 is located at the intersection of the flange shield tab 1762 and the vane shield tab 1764 and the intersection of the pin 1790 and the tabs 1762, 1764.

Figure 14A:
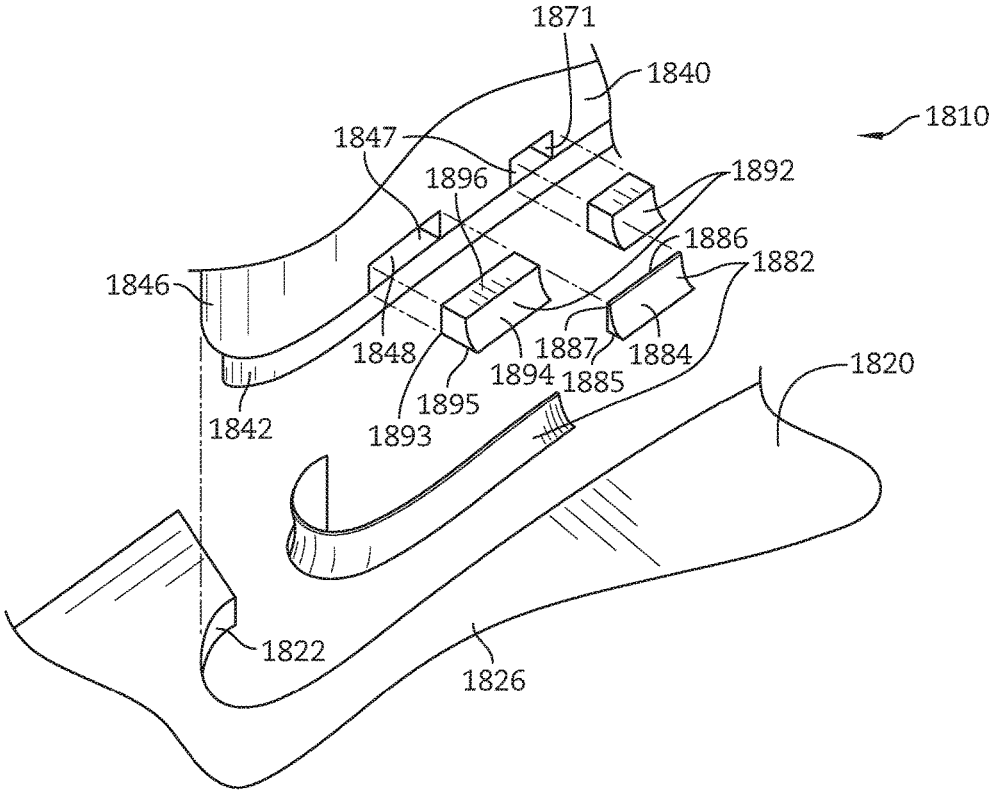
FIG. 14A is a diagrammatic view of another embodiment of a heat shield in accordance with the present disclosure showing that the heat shield includes an inner-flange shield, a vane shield spaced apart from the inner-flange shield, a constructed joint including two pins and two fairings and suggesting that pins and fairings alternate to create a larger area for a co-processing bond to be established as suggested in FIGS. 14B and 14C.
Figure 14B:
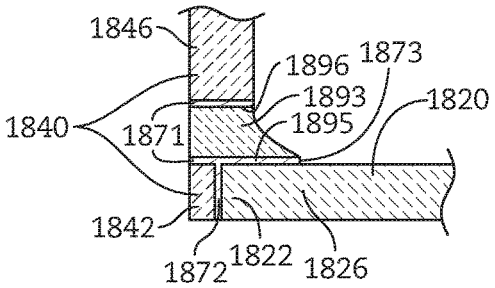
FIG. 14B is a diagrammatic view of one portion of a constructed joint formed between the vane shield and the flange shield of FIG. 14A showing the constructed joint at a location where one of the pins is used to couple the vane shield and flange shield together and showing the co-processing bond between the vane shield, the pin, and the flange shield.
Figure 14C:
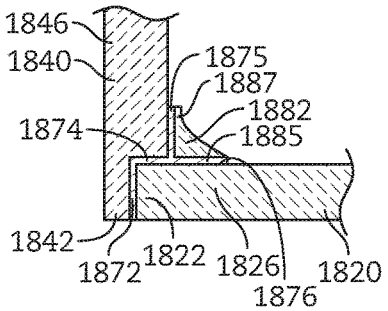
FIG. 14C is a diagrammatic view of another portion of the constructed joint formed between the vane shield and the flange shield of FIG. 14A showing the constructed joint at a location where the vane shield is coupled to the flange shield by the fairings and showing the co-processing bond between the vane shield, the fairing, and the flange shield.

Another embodiment of a heat shield 1810 in accordance with the present disclosure is shown in FIG. 14A. The heat shield 1810 includes a flange shield 1820, a vane shield 1840, a plurality of pins 1892, and a plurality of fairings 1882. Each of the plurality of pins 1892 engages one or two of the plurality of fairings 1882. The flange shield 1820 includes a flange shield body 1826 and a flange shield vane edge 1822. The vane shield 1840 includes a vane shield body 1846 and a vane shield flange edge 1842. The vane shield flange edge 1842 is thinner than the vane shield body 1846. The vane shield 1840 is formed to include a plurality of recesses 1847 extending from the vane shield body 1846 to the vane shield flange edge 1842. As shown in FIG. 14A, a first pin 1893 of the plurality of pins 1892, includes a bottom side 1895, a top side 1896 opposite the bottom side 1895, and a curved side 1894 extending from the top side 1896 to the bottom side 1895. The bottom side 1895 is longer than the top side 1896. A first recess 1848 of the plurality of recesses 1847 is configured to receive the first pin 1893. As shown in FIG. 14B, the top side 1896 of the first pin 1893 engages the vane shield body 1846. The bottom side 1895 of the first pin 1893 engages the vane shield flange edge 1842, the flange shield vane edge 1822, and the flange shield body 1826. The vane shield flange edge 1842 engages the flange shield vane edge 1822. As shown in FIG. 14A, each of the plurality of fairings 1882 include a bottom side 1885, a back side 1887, a top side 1886 opposite the bottom side 1885, and a curved side 1884 extending from the top side 1886 to the bottom side 1885. The bottom side 1885 is longer than the top side 1886. As shown in FIG. 14C, the back side 1887 of the plurality of fairings 1882 engages the vane shield body 1846. The bottom side 1885 of the plurality of fairings 1882 engages the flange shield body 1826. The vane shield flange edge 1842 engages the flange shield vane edge 1822. The vane shield body 1846 engages the flange shield vane edge 1822.

The plurality of the pins 1892 and the plurality of the fairings 1882 are comprised of the same material as the heat shield 1810. The heat shield 1810, the plurality of pins 1892, and the plurality of the fairings 1882 may be comprised of ceramic matrix composite. All of the engaged ceramic components may be co-processed together as suggested in FIGS. 14A, 14B, and 14C.

A first plurality of co-processing bonds 1871 are located at the intersection of the plurality of pins 1892 and the vane shield 1840. A second plurality of co-processing bonds 1872 are located at the intersection of the vane shield flange edge 1842 and the flange shield vane edge 1822. A third plurality of co-processing bonds 1873 are located at the intersection of the plurality of pins 1892 and the flange shield 1820. A fourth plurality of co-processing bonds 1874 are located at the intersection of the vane shield body 1846 and the flange shield vane edge 1822. A fifth plurality of co-processing bonds 1875 are located at the intersection of the vane shield body 1846 and the plurality of fairings 1882. A sixth plurality of co-processing bonds 1876 is located at the intersection of the flange shield body 1826 and the plurality of fairings 1882.

Figure 15A:
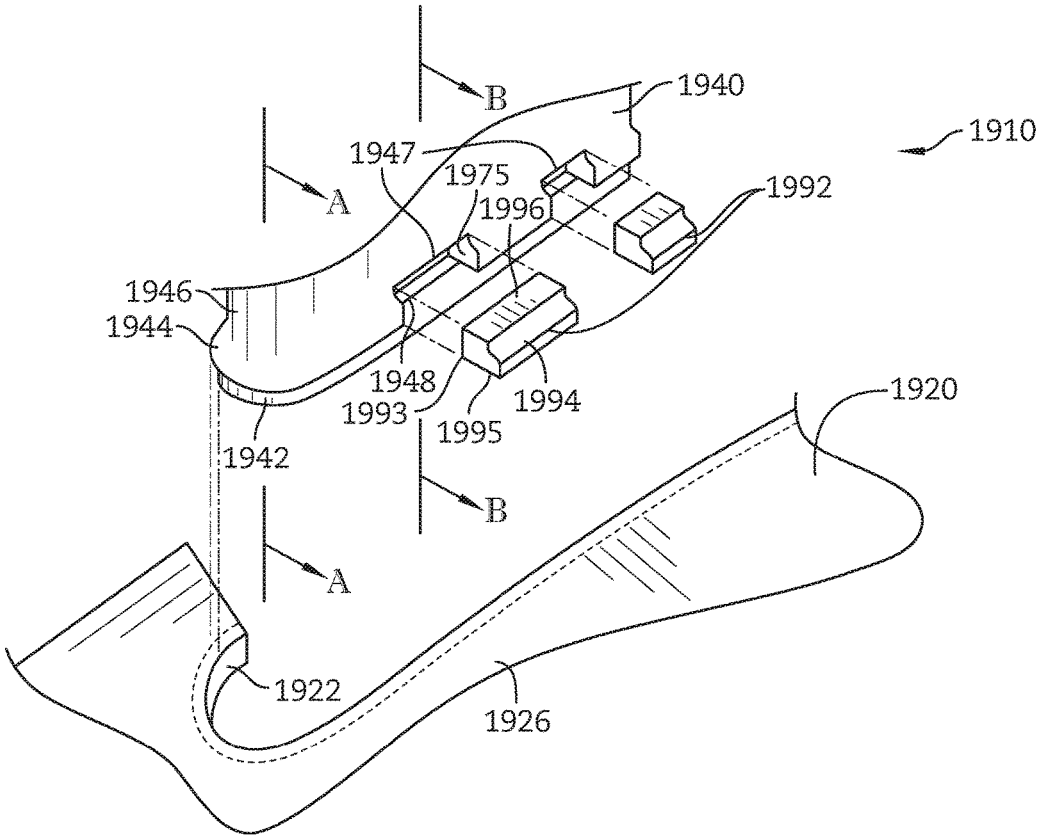
FIG. 15A is a diagrammatic view of another embodiment of a heat shield in accordance with the present disclosure showing that the heat shield includes a flange shield, a vane shield, a vane shield flange edge, and a vane shield lip.
Figure 15B:
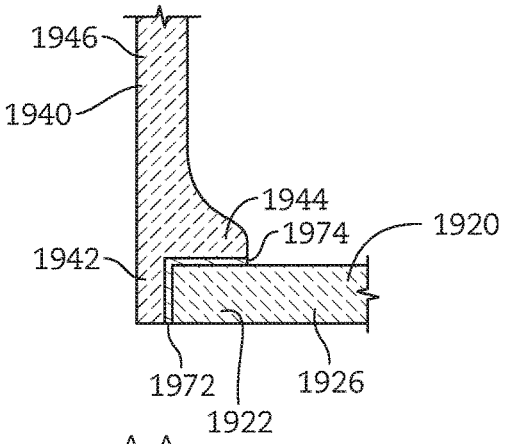
FIG. 15B is a sectional and diagrammatic view taken along line A-A of a portion of the heat shield of FIG. 15A showing a co-processing bond between the vane shield and the flange shield.
Figure 15C:
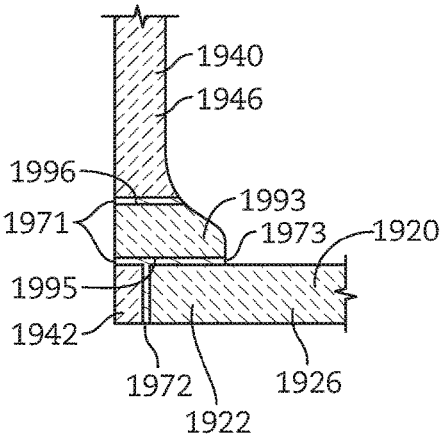
FIG. 15C is a sectional and diagrammatic view taken along line B-B of the heat shield of FIG. 15A showing another co-processing bond between the vane shield, the flange shield, and a pin.

Another embodiment of a heat shield 1910 in accordance with the present disclosure is shown in FIG. 15A. The heat shield 1910 includes a flange shield 1920, a vane shield 1940, and a plurality of pins 1992. The vane shield 1940 includes a vane shield body 1946, a vane shield flange edge 1942, and a vane shield lip 1944 extending between the vane shield body 1946 and the vane shield flange edge 1942. The vane shield lip 1944 is thicker than the vane shield flange edge 1942. The vane shield lip 1944 is thicker than at least a portion of the vane shield body 1946. As shown in FIG. 15B, flange shield 1920 includes a flange shield body 1926 and a flange shield vane edge 1922. The inner-flange shield vane edge 1922 engages the vane shield flange edge 1942 and the vane shield lip 1944. As shown in FIG. 15A, the vane shield lip 1944 is formed to include a plurality of recesses 1947 extending from the vane shield body 1946 to the vane shield flange edge 1942. Each of the plurality of pins 1992 engages the vane shield lip 1944. The flange shield 1920 includes a flange shield body 1926 and a flange shield vane edge 1922. As shown in FIG. 15A, a first pin 1993 of the plurality of pins 1992, includes a bottom side 1995, a top side 1996 opposite the bottom side 1995, and a curved side 1994 extending from the top side 1996 to the bottom side 1995. The bottom side 1995 is longer than the top side 1996. A first recess 1948 of the plurality of recesses 1947 is configured to receive the first pin 1993. As shown in FIG. 15C, the top side 1996 of the first pin 1993 engages the vane shield body 1946. The bottom side 1995 of the first pin 1993 engages the vane shield flange edge 1942, and the flange shield vane edge 1922, and the flange shield body 1926. The vane shield flange edge 1942 engages the flange shield vane edge 1922.

The plurality of the pins 1992 are comprised of the same material as the heat shield 1910. The heat shield 1910 and the plurality of pins 1992 may be comprised of ceramic matrix composite. All of the engaged ceramic components may be co-processed together as suggested in FIGS. 15A, 15B, and 15C.

A first plurality of co-processing bonds 1971 are located at the intersection of the plurality of pins 1992 and the vane shield 1940. A second plurality of co-processing bonds 1972 are located at the intersection of the vane shield flange edge 1942 and the flange shield vane edge 1922. A third plurality of co-processing bonds 1973 are located at the intersection of the plurality of pins 1992 and the flange shield 1920. A fourth plurality of co-processing bonds 1974 are located at the intersection of the vane shield lip 1944 and the flange shield 1920. A fifth plurality of co-processing bonds 1975 are located at the intersection of the plurality of pins 1992 and the vane shield lip 1944.

Figure 15D:
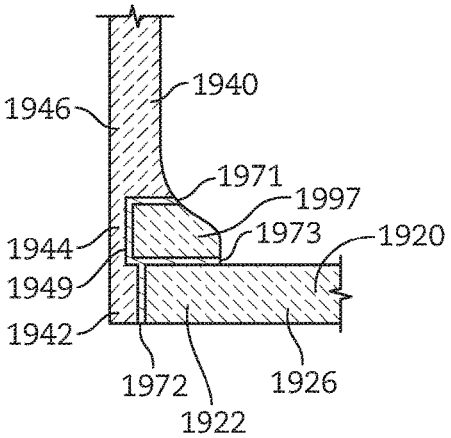
FIG. 15D is a sectional and diagrammatic view of another portion of the heat shield of FIG. 15A showing yet another co-processing bond between the vane shield, the flange shield, and another pin.

As shown in FIG. 15D, each of the plurality of recesses 1947 may be similar to a recess 1949 formed in the vane shield lip 1944 between the vane shield body 1946 and the vane shield flange edge 1942. Each of the pins 1992 may be similar to a pin 1997 that engages the vane shield body 1946, the vane shield lip 1944, the vane shield flange edge 1942, the flange shield vane edge 1922, and the flange shield body 1926. All of the engaged ceramic components may be co-processed together as suggested in FIGS. 15A, 15B, and 15D.

In one embodiment, a gas turbine engine includes a turbine. The turbine includes turbine-vane rings and turbine-blade disks which may alternate in series from a front of the turbine to a rear of the turbine. The turbine-blade disk includes a series of turbine blade assemblies. Each turbine-blade assembly includes a blade unit and heat shield. The blade unit includes a blade root and a blade. The heat shield includes a root shield and a blade shield. The heat shield is coupled to the blade unit to move therewith and be retained on the blade unit as the turbine blade disk spins.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A turbine-vane assembly comprising a vane unit including an inner flange that extends circumferentially relative to an axis, an outer flange located in spaced-apart radial relation to the inner flange and that extends circumferentially relative to the axis, and a metallic vane extending radially between and interconnecting the inner and outer flanges, a heat shield comprising ceramic matrix composite material, the heat shield includes a ceramic matrix composite vane shield, a ceramic matrix composite inner-flange shield coupled to the ceramic matrix composite vane shield and extending circumferentially away from the metallic vane along the inner flange to define an inner boundary of a flow path for hot gases, and a ceramic matrix composite outer-flange shield coupled to the ceramic matrix composite vane shield and extending circumferentially away from the metallic vane along the outer flange to define an outer boundary of the flow path for hot gases, and the ceramic matrix composite vane shield extends radially along the metallic vane and interconnects the inner and outer flange shields, and a second vane unit located circumferentially neighboring the vane unit, the second vane unit includes a second metallic vane formed to define an inner recess that extends circumferentially into the second metallic vane and an outer recess that extends circumferentially into the second metallic vane, the outer recess is spaced apart radially from the inner recess, a portion of the ceramic matrix composite inner-flange shield is located in the inner recess of the second metallic vane, and a portion of the ceramic matrix composite outer-flange shield is located in the outer recess of the second metallic vane, wherein the ceramic matrix composite vane shield is joined to the ceramic matrix composite inner-flange shield by a first bond and the ceramic matrix composite vane shield is joined to the ceramic matrix composite outer-flange shield by a second bond.

2. The turbine-vane assembly of claim 1, wherein the ceramic matrix composite vane shield extends along a pressure side of the metallic vane.

3. The turbine-vane assembly of claim 2, wherein the ceramic matrix composite inner-flange shield is in spaced-apart relation to the inner flange, the ceramic matrix composite vane shield is in spaced-apart relation to the pressure side of the metallic vane, and the ceramic matrix composite outer-flange shield is in spaced-apart relation to the outer flange.

4. The turbine-vane assembly of claim 1, wherein the ceramic matrix composite vane shield includes a vane shield body and a vane shield inner-flange edge and the vane shield inner-flange edge is located at the first bond and comprises a first plurality of teeth, the ceramic matrix composite inner-flange shield includes an inner-flange shield body and an inner-flange shield vane edge and the inner-flange shield vane edge is located at the first bond and comprises a second plurality of teeth, and the first plurality of teeth and the second plurality of teeth are mated together.

5. The turbine-vane assembly of claim 4, wherein each tooth in the first plurality of teeth and the second plurality of teeth has a substantially rectangular shape.

6. The turbine-vane assembly of claim 1, wherein the ceramic matrix composite vane shield includes a vane shield body, a vane shield inner-flange edge, and a first vane shield tab extending from the vane shield inner-flange edge, the ceramic matrix composite inner-flange shield includes an inner-flange shield body, an inner-flange shield vane edge, and an inner-flange shield tab extending from the inner-flange shield vane edge, a first cavity is formed in the first vane shield tab and a second cavity is formed in the inner-flange shield tab, the first and second cavities are aligned and configured to receive a pin therein, and the first bond is located at an intersection of the cavities and the pin.

7. The turbine-vane assembly of claim 1, wherein the ceramic matrix composite vane shield includes a vane shield body, a vane shield inner-flange edge, and a first vane shield lip extending between the vane shield body and the vane shield inner-flange edge, the first vane shield lip is thicker than the vane shield inner-flange edge and the first vane shield lip is thicker than a portion of the vane shield body, the ceramic matrix composite inner-flange shield includes an inner-flange shield body and an inner-flange shield vane edge, the inner-flange shield vane edge engages the vane shield inner-flange edge and the first vane shield lip, and the first bond is located at an intersection of the inner-flange shield vane edge and the vane shield inner-flange edge and at an intersection of the first vane shield lip and the inner-flange shield vane edge.

8. The turbine-vane assembly of claim 1, wherein the ceramic matrix composite inner-flange shield includes an inner-flange shield body, an inner-flange shield vane edge, and an inner-flange shield lip extending between the inner-flange shield body and the inner-flange shield vane edge, the inner-flange shield lip is thicker than the inner-flange shield vane edge, the ceramic matrix composite vane shield includes a vane shield body and a vane shield inner-flange edge, the vane shield inner-flange edge engages the inner-flange shield vane edge and the inner-flange shield lip, and the first bond is located at an intersection of the vane shield inner-flange edge and the inner-flange shield vane edge and at an intersection of the inner-flange shield lip and the vane shield inner-flange edge.

9. The turbine-vane assembly of claim 1, wherein the ceramic matrix composite vane shield includes a vane shield body, a vane shield inner-flange edge, and a first plurality of cavities formed in the vane shield body, the ceramic matrix composite inner-flange shield includes an inner-flange shield body and an inner-flange shield vane edge, the first plurality of cavities formed in the vane shield body are each configured to receive a pin, the pins engage the vane shield inner-flange edge, the vane shield body, and the inner-flange shield vane edge, a plurality of fairings engage the vane shield body, the inner-flange shield vane edge, and at least one of the pins, and the first bond is located at an intersection of the pins and the vane shield body, an intersection of the pins and the vane shield inner-flange edge, an intersection of the pins and the inner-flange shield vane edge, an intersection of the pins and the plurality of fairings, an intersection of the plurality of fairings and the vane shield body, and an intersection of the plurality of fairings and the inner-flange shield vane edge.

10. The turbine-vane assembly of claim 1, wherein the ceramic matrix composite vane shield is located in spaced-apart relation to the metallic vane to define a first passage therebetween.

11. The turbine-vane assembly of claim 10, further comprising a plurality of spacing nubs located between the ceramic matrix composite vane shield and the metallic vane.

12. The turbine-vane assembly of claim 10, wherein the inner flange is located in spaced-apart relation to the ceramic matrix composite inner-flange shield to define a second passage therebetween.

13. The turbine-vane assembly of claim 12, wherein the outer flange is located in spaced-apart relation to the ceramic matrix composite outer-flange shield to define a third passage therebetween.

14. The turbine-vane assembly of claim 1, wherein the ceramic matrix composite inner-flange shield is coupled to the inner flange in a fixed position relative to the inner flange, the ceramic matrix composite outer-flange shield is coupled to the outer flange in a fixed position relative to the outer flange, and the ceramic matrix composite vane shield is coupled to the metallic vane in a fixed position relative to the metallic vane.

15. The turbine-vane assembly of claim 1, wherein the heat shield comprises a single fiber preform and a ceramic matrix deposited onto the single fiber preform to cause the ceramic matrix composite vane shield, the ceramic matrix composite inner-flange shield, and the ceramic matrix composite outer-flange shield to be formed integrally.

16. A turbine-vane assembly comprising a first vane unit that includes an inner flange that extends circumferentially relative to an axis, an outer flange located in spaced-apart radial relation to the inner flange and that extends circumferentially relative to the axis, and a vane that extends radially between and interconnects the inner flange and the outer flange a heat shield comprised of ceramic matrix composite material, the heat shield includes a vane shield, an inner-flange shield that extends circumferentially away from the vane shield along the inner flange, and an outer-flange shield that extends circumferentially away from the vane shield along the outer flange and the vane shield extends radially along the vane and interconnects the inner flange shield and the outer flange shield, and a second vane unit that includes a vane formed to define an inner recess that extends circumferentially into the vane of the second vane unit and an outer recess that extends circumferentially into the vane of the second vane unit, the outer recess is spaced apart radially from the inner recess, the inner-flange shield extends into the inner recess, and the outer-flange shield extends into the outer recess.

* * * * *